US006702223B2

(12) United States Patent
Krüger et al.

(10) Patent No.: US 6,702,223 B2
(45) Date of Patent: Mar. 9, 2004

(54) WINDING HEAD OF A TEXTILE MACHINE

(75) Inventors: Andreas Krüger, Mönchengladbach (DE); Christian Sturm, Krefeld (DE)

(73) Assignee: W. Schlafhorst AG & Co., Moenchengladbach (DE)

( * ) Notice: Subject to any disclaimer, the term of this patent is extended or adjusted under 35 U.S.C. 154(b) by 0 days.

(21) Appl. No.: 10/122,478

(22) Filed: Apr. 15, 2002

(65) Prior Publication Data

US 2002/0148920 A1 Oct. 17, 2002

(30) Foreign Application Priority Data

Apr. 14, 2001 (DE) ..... 101 18 659

(51) Int. Cl.[7] ..... B65H 54/22; B65H 63/08; B65H 67/08

(52) U.S. Cl. ..... 242/475.6; 242/485.2; 242/485.5

(58) Field of Search ..... 242/485.2, 475.6, 242/485.5; 73/160; 700/126, 139, 143

(56) References Cited

U.S. PATENT DOCUMENTS

| | | | | |
|---|---|---|---|---|
| 3,303,419 A | * | 2/1967 | Gith | 73/160 |
| 3,739,996 A | | 6/1973 | Matsui et al. | |
| 3,748,707 A | * | 7/1973 | Aihara et al. | 73/160 |
| 3,988,879 A | | 11/1976 | Franzolini et al. | |
| 4,033,107 A | | 7/1977 | Sasayama et al. | |
| 4,041,610 A | * | 8/1977 | Uesugi et al. | 33/751 |
| 4,078,737 A | | 3/1978 | Rehr | |
| 4,300,094 A | * | 11/1981 | Piso et al. | 73/160 |
| 4,768,026 A | * | 8/1988 | Makino | 73/160 |
| 4,817,425 A | * | 4/1989 | Ueda et al. | 73/160 |
| 5,772,136 A | * | 6/1998 | Gilbos et al. | 242/475.6 |
| 5,862,660 A | | 1/1999 | Haasen et al. | |
| 6,533,211 B2 | * | 3/2003 | Kargel et al. | 242/475.5 |

FOREIGN PATENT DOCUMENTS

| | | |
|---|---|---|
| CH | 397 499 | 8/1965 |
| DE | AS 22 16 960 B2 | 10/1972 |
| DE | 24 60 252 | 7/1976 |
| DE | 0 016 871 | 10/1980 |
| DE | 669 777 | 4/1989 |
| DE | 35 29 663 C2 | 5/1991 |
| DE | 42 25 842 A1 | 2/1994 |
| DE | 43 27 587 A1 | 2/1995 |
| DE | 196 40 184 A1 | 4/1998 |

OTHER PUBLICATIONS

"Fadenlängenzähler für Spulmaschinen", *Melliand Textilberichte*, Gerhard Kröger, (Aug. 1969) P912–915.
"für die praxis aus der forschung", *Textil Praxis International*, (Jul. 1984) P665–666.
German Search Report.

* cited by examiner

*Primary Examiner*—John M. Jillions
(74) *Attorney, Agent, or Firm*—Kennedy Covington Lobdell & Hickman, LLP

(57) ABSTRACT

A winding head of a cheese-producing textile machine, having a device for the accurate determination of the length of yarn traveling through a measuring head (7), and having an evaluating device for accumulating the yarn lengths that have passed. The winding head has a device for determining yarn length portions which are removed in the course of a yarn connecting process. The evaluation device is adapted to subtract the removed yarn lengths from the total length of the yarn (2) which has passed through the measuring head.

6 Claims, 3 Drawing Sheets

WINDING HEAD OF A TEXTILE MACHINE

CROSS-REFERENCES TO RELATED APPLICATIONS

This application claims the benefit of German Patent Application 10118659.2 filed Apr. 14, 2001, herein incorporated by reference.

BACKGROUND OF THE INVENTION

The present invention relates to a winding head of a textile machine.

It is known that considerable reductions of costs are possible, for example in preparation for fabric weaving, if the preset lengths of the yarn wound on the cheeses can be maintained as accurately as possible. This applies in particular when cheeses are placed together on a bank creel to be drawn off and warped or beamed. The greater the deviations in yarn length from one cheese to another, the greater the differences between the residual amounts of yarn left on the cheeses at the completion of the warp or beam. With high-quality yarn material, this problem leads to intolerable losses because of considerable amounts of wasted yarn, or to the necessity for elaborate and time-consuming re-winding of the residual yarn. In cheese-producing textile machines, it is customary to derive the length of yarn wound onto each cheese from the revolutions of the cheese or the revolutions of the drive roller for the cheeses during winding of the cheeses. Considerable inaccuracies in detecting the yarn length, or the yarn speed, can occur because of factors such as slippage or traversing motions.

Devices and methods are used for preventing such inaccuracies, by means of which the traveling yarn can be measured in a contactless manner, and signals which are proportional to the yarn speed can be generated. The speed which has been determined by means of a running time correlator, for example, can be evaluated for the determination of the length of the running time of a textile yarn.

For example, Swiss Patent Publication CH 669 777 A5 describes a method and a device for the contactless length measurement of a yarn wherein, by means of an optical correlation system having a screen and at least one photoelectrical detector, a yarn section is illuminated whose image is converted into an electrical push-pull signal containing a frequency proportional to the speed wherein, after separating push-pull portions and interference signals, the period length of the signal is respectively measured at least once during a scanning interval of a constant length of time if the signal exceeds a minimum amplitude value, and the length is determined from the individual measured length values, which were determined by forming the reciprocal value. A signal proportional to the yarn speed is generated in a contactless manner by the reproduction of a yarn section on a screen and photoelectrical conversion. The signal is scanned at fixed scanning intervals and the partial yarn length for each scanning interval is determined. The yarn length results from the addition of the partial lengths.

The method disclosed in German Patent Publication DE 43 27 587 A1 operates with a running time correlator. Here, the speed of the running yarn is measured at least at one reference winding location, a mean value is formed from this measurement and this mean value is used as the basis of the preset value of the winding speed at the remaining winding heads. By means of the direct detection of the winding speed at the running yarn, it is intended for the determination of the production output to reduce or eliminate the effects of interference factors, which heretofore have negatively affected the accuracy of the determination of the production output. The employment of such a measuring device for determining the winding speed of the running yarn only at one or a few winding heads of a cheese-producing textile machine is intended to provide a considerable savings in comparison to the arrangement of such measuring devices at all winding heads. However, using a few reference winding heads, or even only a single reference winding head out of a plurality of windings heads of the winding frame, it is not possible to assure that every cheese finished on this winding frame has a yarn length which matches with a sufficient accuracy the preset yarn length for use in the weaving preparation. The deviations from length between the detected, or determined produced amounts of yarn, which still occur even at reference winding heads, and the actual length of yarn wound on the cheese, are marginal in comparison to the production output and can therefore be easily neglected in the course of the determination of the production output of the entire winding frame. However, these deviations in length are no longer tolerable for the precise maintenance of a preset yarn length. Thus, a winding frame designed in accordance with German Patent Publication DE 43 27 587 A1 does not meet the greater demands made for agreement of the preset yarn length with the yarn length which is actually wound on the respective cheese.

As described in German Patent Publication DE 42 25 842 A1, European Patent Disclosure EP 0 000 721 A1 proposed to determine the yarn speed via two sensors disposed at a fixed distance from one another and operating in a contactless fashion. Sensors that operate optically or capacitatively, for instance, can be considered for this. These sensors detect stochastic yarn signals in the form of analog noise signals that result from irregularities in the yarn surface or yarn mass in the longitudinal direction of the yarn. The stochastic signal determined upstream in the yarn running direction is shifted temporally until it bears maximum similarity to the stochastic signal detected by the sensor disposed downstream. The thus-determined delay of the first signal corresponds to the time span required by the yarn to travel from the first to the second sensor. Because the spacing of the two sensors is known, the yarn speed can easily be determined in this manner. Typically, the mathematical operations typically characterized as cross-correlation methods are employed to achieve this; however, these calculations are time-consuming. The delay is not problematic when the yarn experiences no or only very little acceleration. However, rapid changes in speed, such as occur in the winding process after yarn breakage or bobbin changing, for instance, can not be controlled well enough in this manner to allow for precise measurement.

German Patent Publication DE 42 25 842 A1 incorporates and improves upon the running time correlator of European Patent Disclosure EP 0 000 721 A1. German Patent Publication DE 42 25 842 A1 shows a device for measuring the speed of textile yarns on a winding apparatus. The winding apparatus is used for producing cheeses, wherein the rotation of the cheese is created by means of the frictional effect from a drive roller. A running time correlator circuit such as the one described above with two measuring points, which are arranged at a fixed distance in the movement direction of the running textile yarn and where a contactless measurement is performed, and a further signal transmitter are connected with each other. The signal transmitter detects the rotary movement of the drive roller and emits signals which are proportional to the yarn speed. These signals are supplied to the running time correlator for presetting the range for latching of the control circuit to the correct maximum idle time (i.e., maximum of the correlation function for the running time of the yarn from the first to the second measuring point constitutes the idle time). As a result, it is possible to utilize the high degree of measuring accuracy of the running time correlator without a considerable outlay in computing capacity even at changing yarn speeds. The speed determined by means of the running time correlator can be directly evaluated via an integrator for the accumulated running time length determination of a textile yarn.

The publications cited above describe possibilities for precisely determining the yarn speed. However, the agreement of the yarn length wound on the cheese with the preset yarn length, as well as in a comparison of the cheeses with each other, still is insufficient for the greatest demands made on accuracy, in spite of a length measurement by means of the devices and methods described above.

SUMMARY OF THE INVENTION

It is accordingly an object of the present invention to improve the determination and storage of preset yarn lengths for cheeses.

This object is attained by providing a yarn winding head of a cheese-producing textile machine, with a device for accurately determining a cumulative length of yarn which has traveled through a yarn sensor, a device for determining a length portion of yarn removed in performing a yarn connecting process, and an evaluating device for calculating and storing a net yarn length wound onto a cheese at the winding head by subtracting the removed yarn length portion from the cumulative length of yarn which has traveled through the yarn sensor.

Thus, a winding head embodied in accordance with the invention is operative to subtract the partial lengths of removed yarn from the total cumulative length of the wound yarn derived from the yarn length which has traveled through the yarn sensor, whereby the calculated result determined in this manner is close to the actual value of the wound yarn length. This operation clearly increases the accuracy with which it is possible to maintain preset yarn lengths of cheeses, and leads to an improved utilization of the possibilities made available by a device for the most accurate determination of a yarn length passing through the yarn sensor.

In order to assure that it is possible, for example, to draw the required warp ends off a cheese in every case, it is customary under conventional practices to select the preset yarn length to be much greater than the yarn length actually required for the warping process. It is intended in this manner to provide for the possibility that, at the time the yarn length determined by conventional means of length measurement reaches the preset yarn length and the winding process is terminated, the yarn length actually wound on the cheese is less than the preset yarn length and is therefore not suitable for the desired use. While this customarily large amount of added yarn length is done for reasons of safety, the grave disadvantage thereby accepted is that large amounts of yarn are left on the bobbins as residual yarn, for example during the weaving preparation. Because of the clearly improved accuracy with which yarn lengths of a cheese can be maintained at a winding head embodied in accordance with the present invention, the additional yarn wound for safety can be kept very small in the process of presetting the yarn length, which leads to a significant reduction in the residual amounts of yarn left on the cheeses.

Preferably, the present device for the accurate determination of the length of the traveling yarn has a contactlessly operating measuring head with two measuring points, which are arranged in series with each other in the traveling direction of the yarn, as well as a running time correlator for processing the detected measured values. Advantageously, a particularly high accuracy can be achieved for the measurement of the yarn speed and the determination of the length of the running yarn.

It is also preferred that the running time correlator receives signals for presetting of the range for the correct latching on of the control circuit, which signals are generated by means of an angle sensor used for recording the circumferential speed of a drive roller for the cheese. In this manner, it is possible to react flexibly to speed changes, without a large computing effort and without a resultantly long computing time being required. Latching on to a secondary lobe, and therefore the generation of a false speed value, can be avoided.

The device for determining the lengths of removed yarn advantageously has a yarn end sensor arranged on an aspirating element which generates a start signal upon detecting the presence of a connecting end of yarn which was removed from the surface of the cheese by means of the aspirating element. The evaluation device is adapted to determine from the start signal and the signals from the angle sensor the yarn length unwound from the cheese for the yarn connecting operation. In this manner, the determination of the eliminated yarn length can be performed exactly.

The winding head preferably has means for yarn tensile strength control in the path of the yarn. Fluctuations in length of the wound-up yarn caused by variations in the yarn tensile strength are furthermore avoided to the greatest extent by means of such a yarn tensile strength control.

In a preferred embodiment, the evaluation device is embodied such that the determination of the yarn length for the length of yarn wound on the cheese takes place during the start-up of the winding device, at least in the initial phase of the start-up, exclusively on the basis of the signals generated by the angle sensor. A yarn length determination only on the basis of these signals can be terminated when a preset number of revolutions of the cheese is exceeded during the start-up, or a preset acceleration value in the rotary movement of the cheese falls below a set value. This arrangement avoids possible problems in the start-up phase of the rotation of the cheese which might be created because the relatively large time difference initially occurring between the signals from both measuring points causes the data volume which must be stored for the correlation to also be very large. Brief distortions of the determined length values possibly occurring during the relatively short start-up are minimal and can be tolerated, while the required computing outlay for the yarn length determination during the start-up is considerably reduced.

The device in accordance with the present invention makes it possible in a simple but effective way to achieve an extraordinarily precise agreement of the preset yarn length and the length of yarn actually wound onto the cheese. The invention now makes the accuracy of measurement of a correlation method with the aid of a running time correlator usable to the fullest extent in the course of the determination of the yarn length wound on a cheese.

Further details, features and advantages of the present invention will be described and understood in greater detail by the following disclosure of an exemplary embodiment represented in the accompanying drawings.

DESCRIPTION OF THE PREFERRED EMBODIMENT

Figure 1:
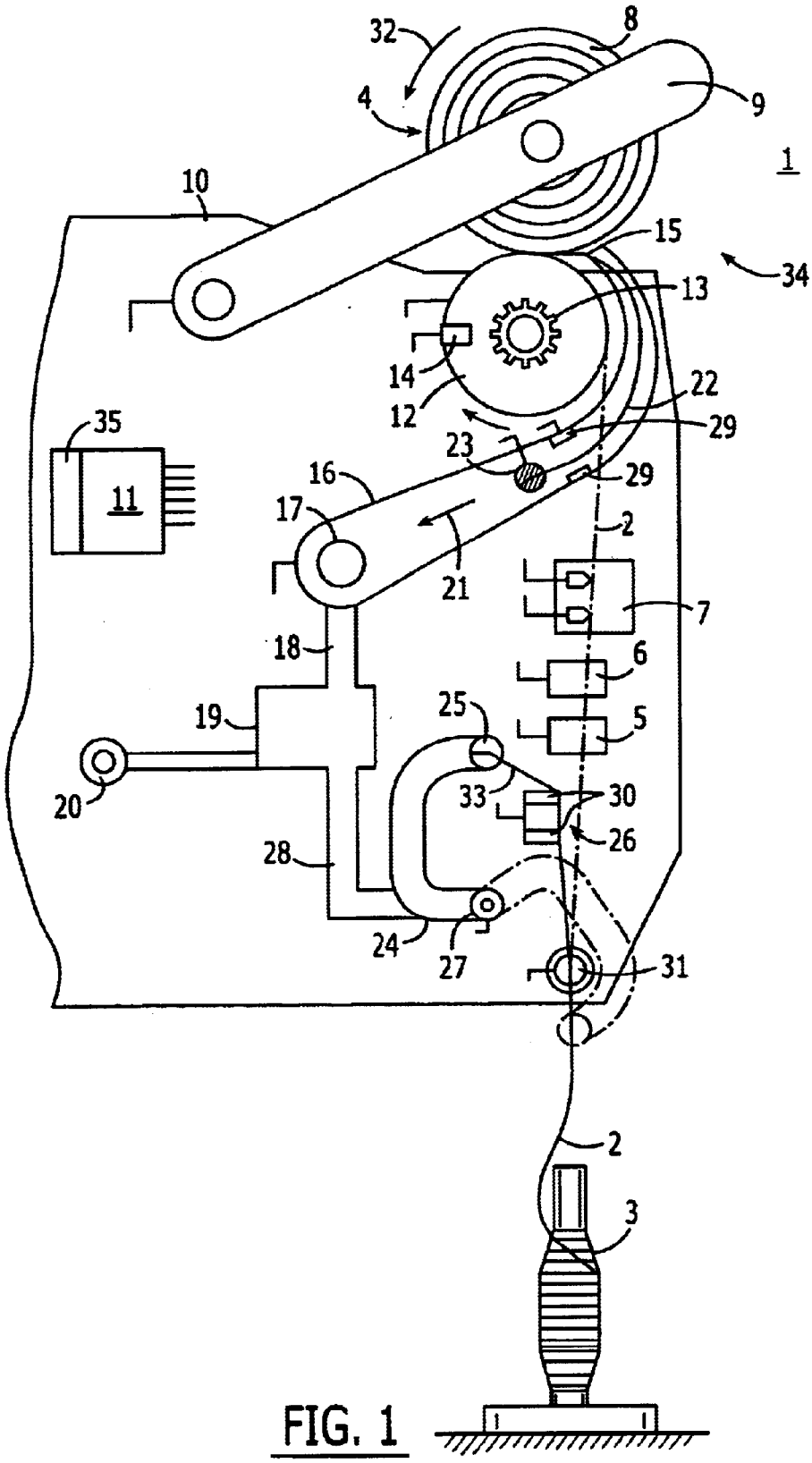
FIG. 1 is a simplified schematic representation of a winding head on a winding frame in accordance with a preferred embodiment of the present invention, FIG. 2is another simplified schematic representation of the winding head of FIG. 1 after two yarn ends requiring connection have been inserted into the yarn connecting device.

Referring now to FIG. 1, a winding head is depicted in which the traveling path of the yarn 2 from the delivery bobbin 3 to the winding bobbin, embodied as a cheese 4, has been interrupted because of a yarn defect detected by a cleaning device 5. The yarn interruption was performed by means of a cutting device 6. The traveling path of the yarn 2 normally taken during the winding operation has been partially represented in dashed lines. In the course of the winding process, the yarn 2 drawn off the delivery bobbin 3 moves past the controlled yarn brake 31, the cleaning device 5, the cutting device 6, as well as the yarn sensor, embodied as the measuring head 7, and is wound in the winding device 34 on the winding body 8 of the cheese 4, which in the representation of FIG. 1 rotates clockwise. The drive roller 12 drives the winding bobbin 4 by means of friction, whereby in the representation of FIG. 1 the drive roller 12 rotates in a counterclockwise direction for winding the yarn. The cheese 4 is supported by a bobbin holder 9, which is pivotably seated on the machine frame 10. A control device 11 comprises an evaluation device for the values measured by the measuring head 7, as well as a running time correlator 35 and is equipped for adding together the yarn lengths which have passed. Such a measuring head 7 in connection with a running time correlator 35 is known, for example, from and is explained in greater detail in German Patent Publication DE 42 25 842 A1, the disclosure of which is incorporated herein by reference, with pertinent sections thereof being reproduced hereinbelow.

The advantageous embodiment of the device for measuring the yarn speed in accordance with German Patent Publication DE 42 25 842 A1 is employed at the winding head 1. Two sensors 106 and 107 are disposed one behind the other in the yarn running direction, with a mutual spacing L, in the measuring head 7. These sensors 106 or 107 are sensors operating in contactless fashion and on an optical or capacitive basis, for example. They detect a stochastic function of the textile yarn 2, formed by fluctuations in mass or volume or other characteristic of the textile yarn 2.

Now, the mathematical relationships involved in this invention will be discussed briefly.

Because it can be assumed that the aforementioned characteristics of the textile yarn 2 do not change between the two contactless sensors 106, 107, it can be concluded that the characteristics detected by the sensor 106 can also be measured at the sensor 107 after a delay by a travel time T, thus resulting in a very good correlation of the two signals. In the simplest terms, the model idle time $\tau$ must be varied until a maximum correlation results. In this case the model idle time $\tau$ equals the actual travel time T.

If the signals detected by the sensor 106 are designated by the function x(t), and the signals detected by the sensor 107 are designated by y(t), in the ideal case it is assumed that $y(t)=x(t-T)$. To determine T, x(t) must be artificially delayed by the model idle time $\tau$ until the deviations e(t) become minimal in the quadratic sense, that is, that the mathematical expected value E approaches zero. The result is the following condition for the expected value E:

$$E\{[y(t)-x(t-\tau)]x\ x(t-\tau)\}=0$$

Because the expected value E, which is a mean value, has different operational signs (+or −) to the right and left of the balance point t=T, a standard deviation of a normal control circuit results. Mathematically this is a gradient method.

Figure 3:
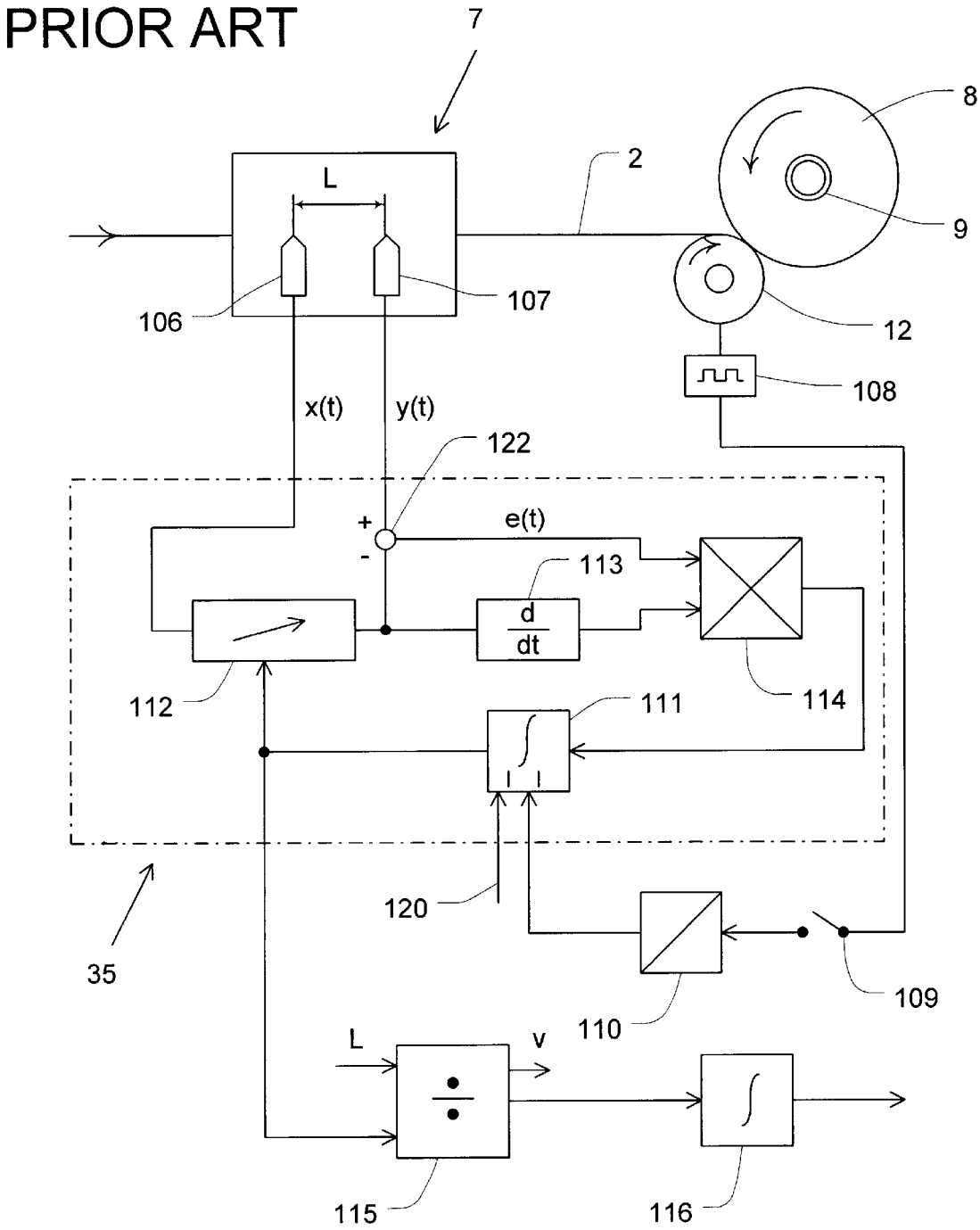
FIG. 3 is a diagram of a circuit for determining the yarn speed or running length for use with the winding head of FIGS. 1 and 2.

The travel time correlator 35 in FIG. 3 functions to realize this control function or satisfy the aforementioned equation in the following manner. The signal train x(t) is supplied to a delay member 112 that shifts this signal train by the model idle time $\tau$. The result is a signal train of the model $y_M=x(t-\tau)$, which is supplied on the one hand to a differentiator 113 and on the other to a balance point 122. However, the non-time-delayed signal train y(t) of the sensor 107 is also supplied to the balance point 122. The deviation e(t), which consequently corresponds to the difference $y(t)-x(t-\tau)$, is supplied to a multiplier 114 as one factor. The other factor from the above equation is formed in the differentiator 113 by means of differentiation of the time-delayed signal train $x(t-\tau)$. The product formed in the multiplier 114 is then fed into the feedback integrator 111, which in turn has a connection to the delay member 112 and there readjusts the model idle time when there are deviations between $\tau$ and T.

If the deviation e(t) is zero, which corresponds to the stable state of the system, the feedback integrator 111 also sends no pulses to the delay member 112, so that no change is made on the model, that is, on the setting of the model idle time $\tau$. The model idle time $\tau$ is then identical to the yarn travel time in the sensor, which corresponds to the correlation maximum.

With this method the danger exists that the travel time correlator will lock onto a secondary maximum, that is, an incorrect balance point, by means of which a variable that deviates from the actual travel time T is made the basis of the determination of speed, depending on the length of time until the travel time correlator locks onto the correct maximum.

To avoid this, magnetic pulses from a pulse source connected to the driving roller 12 are received by a sensor or pulse receiver 108, for instance a Hall sensor.

Usually a pulse receiver present on modem bobbin winders, for example, can serve as a signal transducer for producing the signals that are nearly proportional to the yarn speed; this receiver receives the magnetic pulses of a pulse source fixedly attached to a driving roller typically in contact to the package on the winding machine. Likewise, a corresponding pulse receiver directly on the package and whose pulses are coupled with the angular position of the creel is possible, so as to take into account the diameter of the package that influences the circumferential speed in proportion to the rpm. In both cases a flexible adaptation of the measurement results to changing winding speeds is attained. The insufficient measuring precision is not influential, because the signals supplied to the travel time correlator only serve to preset the range.

The density of the pulse sequence received by sensor 108 is a measure for the circumferential speed of the driving roller 12, whose diameter is known, and therefore approximately for the speed of the running textile yarn 2 as well. The pulse receiver 108 consequently acts as a signal transducer of signals that are proportional to the yarn speed in the sense of the present invention. The signal train of square wave signals is supplied to a frequency-to-voltage converter 110 via a switch 109 which is shown in its open position in FIG. 3. This frequency-to-voltage converter 110 is connected on the output side to the feedback integrator 111. The voltage signals from the frequency-to-voltage converter 110, which are proportional to the yarn speed, provide the feedback integrator 111 with a preset range within which the correct idle time maximum of the model idle time $\tau$ lies. It is critical that the range is selected to be so narrow that secondary maxima lie outside this range. The width of the range is therefore fixedly preset via an offset, represented in FIG. 3 by the arrow 120. As a result the range whose width has been fixed is simply shifted by means of the voltage signals at the output side of the frequency-to-voltage converter 110.

The feedback integrator 111 includes a further range comparator (not indicated in FIG. 3) to which the control signals applied to the output side of the actual integrator are fed, along with the range width and the position of the range resulting from the signals of the frequency-to-voltage converter 110. This range comparator conventionally corrects the balance point in the integrator at the output of the integrator if the range limits are exceeded or not met. By means of this, extreme changes in speed are reacted to, and at the same time a departure from the primary maximum in the direction of a secondary maximum that could be locked onto without a correction of the control circuit, possibly for a long time is prevented.

Extreme changes in speed of this nature normally occur only when the yarn speed is brought from zero to the operating speed within a very short time after interruption of the winding process. However, if a correction is required during normal winding because the range limits are exceeded, this suggests an operating malfunction. This can be a result of the occurrence of extremely high slippage between the drive roller and the package, for instance. Thus, if a correction of this kind is made during the normal yarn travel, which is recorded by the winding head computer, the possibility exists of outputting a corresponding trouble signal to notify the user, for example. To provide this additional option, the circuit for the trouble message must be blocked for the time in which the winder "runs up to speed."

In normal operation, that is, during the winding process with slight fluctuations in speed, the range limits are displaced just like the idle time maximum such that during this time no corrections are necessary unless a malfunction occurs.

Aside from its above-described connection to the delay member 112, the output of the feedback integrator 111 is connected to a divider element 115. The fixed distance L between the sensors 106 and 107, which is divided by the values $\tau$ put out by the feedback integrator 111 and which correspond to the actual travel time T to from the respective instantaneous speed value, is stored in this divider element 115. The speed can be displayed, plotted and/or supplied to an integrator 116 for further processing. In the integrator 116 the yarn length wound onto the bobbin tube is cumulatively determined from the very beginning onward of winding of a package.

The control device 11 has a module for storing the preset yarn length and to compare the preset yarn length and the accumulated yarn length with each other. Once the accumulated yarn length has reached the preset value, the winding process is terminated, the cheese 4 taken away and a new winding process is started.

If an impermissible yarn defect is detected by the cleaning device 5, the cutting device 6 is activated and the yarn 2 is severed. The yarn length which has been passed is determined from signals generated by the measuring head 7 only until the yarn end has reached the measuring head 7. The severed yarn end of the so-called upper yarn is wound on the cheese 4. Following the cutting operation, the mouth 15 of an aspirating tube 16 is placed against the circumferential surface of the winding body 8. A valve, not represented here for reasons of simplification, is actuated by the control device 11, the aspirating tube 16 is charged with a vacuum and a suction flow is generated at the mouth 15. In this case, the aspirating tube 16 is connected with the aspirating conduit 19 via the pivot hinge 17 and the line 18, and via the aspirating conduit 19 with the central vacuum source 20 of the winding machine. The direction of the suction flow is indicated by the arrow 21. The severed yarn end 22 resting on the circumferential surface of the winding body 8 is aspirated into the aspirating tube 16. In the course of this operation, the cheese 4 is slowly turned counterclockwise thereby allowing the upper yarn end to be unwound from the cheese. If the cheese 4 takes up an angled position during this rotation, in which the yarn end 22 resting on the circumferential surface of the winding body 8 comes into the effective range of the mouth 15 of the aspirating tube 16, the yarn end 22 is aspirated into the aspirating tube 16 if the aspiration attempt is successful. When the yarn end in the aspirating tube 16 reaches the yarn end sensor 23 in the course of this operation, only a defined yarn length is unwound from the cheese 4 and aspirated into the aspirating tube 16. This length of yarn is detected, with the detection taking place in a known manner by means of the rotation of the drive roller 12 in the direction of the arrow 32. The rotation of the drive roller 12 is measured by means of a magnet wheel 13 and an angle sensor 14. The determination of actuating variables used for detecting the defined length of yarn to be pulled off can be performed in the manner described, for example, in German Patent Publication DE 196 40 184 A1, or in the corresponding U.S. Pat. No. 5,862,660, incorporated herein by reference. The length of the yarn end unwound from the cheese 4 and aspirated by the aspirating tube 16 is subtracted from the accumulated yarn length which has passed through the measuring head 7. The distance of the yarn sensor 23 from the mouth 15 of the aspirating tube 16, as well as the distance traveled in the course of the pivoting movement by the mouth 15 of the aspirating tube 16, and the corresponding yarn length, are known and stored in the control device 11, and are used in the determination of the eliminated yarn length.

The lower yarn gripper tube 24 grasps the yarn end unwound from the delivery bobbin 3, the so-called bottom yarn, by means of the aspirating opening 25 and, by performing a pivoting movement, inserts the yarn end into the yarn end connecting device, which is embodied as a splicing device 26. The pivot hinge 27 around which the yarn gripper tube 24 can be pivoted is embodied as a connector of a line 28, which terminates in the aspirating conduit 19. Following this situation represented in FIG. 1, the aspirating tube is pivoted downwardly around the pivot joint 17 and places the upper yarn into the splicing device 26. In the course of the pivot movement, the yarn end 22 is kept in place by means of a clamping device 29.

Figure 2:
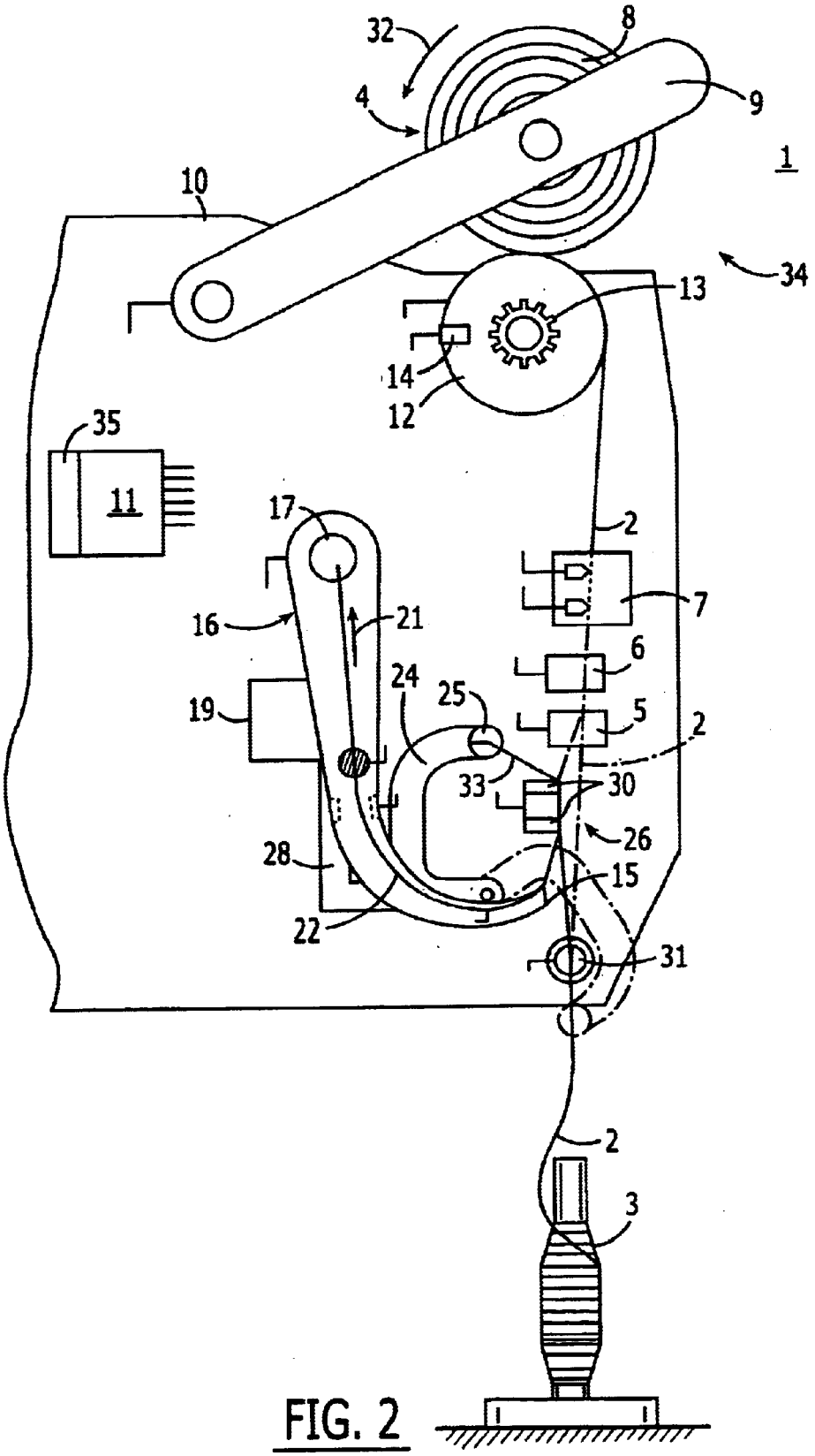

FIG. 2 shows the aspirating tube 19 in the position it has assumed following the downward pivoting movement and prior to the severing of the yarn ends 22 and 33 by the cutting device 30. The length of the yarn end 22 unwound again from the delivery bobbin 3 has been subtracted again by the evaluating device from the accumulated length of the wound yarn 2. The yarn end 33 has not yet passed through the measuring head 7 and is therefore not contained in the accumulated length of the wound yarn.

Following the completion of the yarn connection, the winding process is continued. In the course of this process, the determination of the length of yarn which has passed through the measuring head 7 and the accumulation of the yarn which has run up on the cheese 4 is continued. Once the accumulated length has reached a value preset for the cheese 4, the winding process is terminated, the full cheese 4 taken away and a new winding process is started. Following a bobbin change, as well as after a yarn break, the length of the yarn wound onto the cheese 4 during the start-up of the rotation of the cheese 4 is determined by means of the rotation of the drive roller 12, and not from the evaluation of the values measured by the measuring head 7. No later than the time at which the number of rotations of the drive roller 12 has reached the operating number of rotations are the values measured by the measuring head 7 again used as the basis for detecting the traveling length of the yarn.

The grasping of the yarn and the yarn connecting process are known from German Patent Publication DE 196 40 184 A1, for example, which is incorporated herein by reference and from which further explanations can be obtained. The splicing device 26 comprises a cutting device 30 for severing the two yarn ends 22 and 33 aspirated by the aspirating tube 16 and the yarn gripper tube 24. Cutting devices of this type are known and customary and are therefore not represented here in detail for reasons of simplification. The two yarn ends 22, 33 are severed by means of the cutting device 30, wherein the severed yarn end 22 of the upper yarn contains the detected yarn defect.

The invention is of course not limited to the embodiment represented in FIGS. 1 and 2. To the extent they are not explained in detail here, the method of driving, the seating and the support of parts of the device, as well as the control and linkage, take place in accordance with the prior art, such as ensues from the cited publications and the prior art recited there, for example.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A yarn winding head of a cheese-producing textile machine, comprising a device for accurately determining a cumulative length of yarn which has traveled through a yarn sensor, a device for determining a length portion of yarn removed, from the yarn that has traveled through the yarn sensor, in performing a yarn connecting process, and an evaluating device for calculating and storing a net yarn length wound onto a cheese at the winding head by subtracting the removed yarn length portion from the cumulative length of yarn which has traveled through the yarn sensor.

2. The winding head in accordance with claim 1, characterized in that the device for accurately determining the traveling yarn length has a measuring head adapted for contactless measuring operation via two measuring points arranged in series with one other in the traveling direction of the yarn and a running time correlator for processing values measured by the measuring head.

3. The winding head in accordance with claim 2, characterized in that the running time correlator has a control circuit which adjusts to a maximum idle time, the winding head has a winding device with an angle sensor for determining the circumferential speed of a drive roller for the cheese, the angle sensor being adapted for generating signals which are approximately proportional to the yarn speed and transmitting the signals to the running time correlator for presetting a range for the control circuit to determine a correct maximum idle time.

4. The winding head in accordance with claim 1, further comprising an aspirating element, the winding head being characterized in that the device for determining a length portion of yarn removed in performing a yarn connecting process has a yarn end sensor arranged on the aspirating element to be proximate to a connecting end of yarn aspirated by the aspirating element from the surface of the cheese, the yarn end sensor being adapted to generate a start signal to the evaluating device, and the evaluating device is adapted to determine a yarn length portion unwound from the cheese based upon the start signal and the signals from the angle sensor.

5. The winding head in accordance with claim 1, wherein the yarn traveling through the yarn sensor defines a traveling path, the winding head being characterized in that a device for controlling the yarn tensile strength is arranged in the traveling path of the yarn.

6. The winding head in accordance with claim 3, characterized in that the evaluation device is adapted during at least an initial start-up phase of the winding device for measuring the length of the yarn wound on the cheese solely on the basis of the signals from the angle sensor.

* * * * *